US010612366B2

(12) United States Patent
Gilleland et al.

(10) Patent No.: US 10,612,366 B2
(45) Date of Patent: Apr. 7, 2020

(54) DETECTING LANDING OF A TUBULAR HANGER

(71) Applicant: Saudi Arabian Oil Company, Dhahran (SA)

(72) Inventors: Monty B. Gilleland, Dhahran (SA); Michael Affleck, Aberdeen (GB)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 49 days.

(21) Appl. No.: 15/830,093

(22) Filed: Dec. 4, 2017

(65) Prior Publication Data

US 2019/0169980 A1 Jun. 6, 2019

(51) Int. Cl.
*E21B 33/04* (2006.01)
*E21B 47/09* (2012.01)

(52) U.S. Cl.
CPC ..... *E21B 47/0905* (2013.01); *E21B 33/04* (2013.01); *E21B 47/091* (2013.01)

(58) Field of Classification Search
CPC ..... E21B 47/0905; E21B 33/04; E21B 47/091
See application file for complete search history.

(56) References Cited

U.S. PATENT DOCUMENTS 4,573,359 A * 3/1986 Carstensen ..... G01L 5/24 33/561.2
6,725,924 B2 4/2004 Davidson et al.
8,826,988 B2 9/2014 Gray et al.
2002/0189806 A1 12/2002 Davidson et al.
2005/0088316 A1* 4/2005 Mallison ..... E21B 47/12 340/853.1
2007/0039738 A1 2/2007 Fenton et al.
2011/0083854 A1 4/2011 Jennings
2012/0292035 A1 11/2012 Fenwick
2013/0027215 A1* 1/2013 Kleppa ..... E21B 34/02 340/853.2
2015/0275653 A1 10/2015 Ringgenberg
2016/0069178 A1* 3/2016 Mulholland ..... E21B 33/03 166/65.1
2016/0305232 A1 10/2016 Bird et al.
2016/0312602 A1* 10/2016 Carlson ..... E21B 47/082
2017/0122096 A1* 5/2017 Durtler ..... E21B 47/0905
2018/0163520 A1* 6/2018 Navar ..... E21B 43/10
2018/0258754 A1* 9/2018 Guner ..... E21B 47/02216

OTHER PUBLICATIONS

International Search Report for PCT/IB2018/056511, 5 pages (dated Dec. 21, 2018).
Written Opinion for PCT/IB2018/056511, 8 pages (dated Dec. 21, 2018).
International Preliminary Report on Patentability for PCT/IB2018/056511, 16 pages (dated Oct. 21, 2019).

* cited by examiner

*Primary Examiner* — Giovanna C Wright
*Assistant Examiner* — Brandon M Duck
(74) *Attorney, Agent, or Firm* — Peter A. Flynn

(57) ABSTRACT

An example system includes: a wellhead having a wellhead load shoulder to support, within a wellbore, a tubular hanger connected to a tubular string, where the tubular hanger has a tubular hanger contact shoulder; and one or more sensors to generate one or more signals that are based on at least one of a proximity of the tubular hanger contact shoulder to the wellhead load shoulder or a contact between the tubular hanger contact shoulder and the wellhead load shoulder.

29 Claims, 8 Drawing Sheets

DETECTING LANDING OF A TUBULAR HANGER

TECHNICAL FIELD

This specification relates generally to systems for detecting landing of tubular hangers in a wellhead.

BACKGROUND

During construction of an oil or gas well, a drill string having a drill bit bores through earth, rock, and other materials to form a wellbore. The drilling process includes, among other things, pumping drilling fluid down into the wellbore, and receiving return fluid and materials from the wellbore at the surface. In order for the well to become a production well, the well must be completed. Part of the well construction process includes incorporating casing and production tubing into the wellbore. Casing supports the sides of the wellbore, and protects components of the well from outside contaminants. The casing may be cemented in place, and the cement may be allowed to harden as part of the well construction process.

Tubulars may be, or include, a casing or production tubing string. A tubular string may include, among other things, components or other structures used to suspend and to support tubulars in a wellhead. Tubular strings extending back to the surface are connected to a tubular hanger, which may be landed in a weight-supporting wellhead. Each successive downhole tubular string back to the surface may be connected to a tubular hanger and landed in additional wellheads added to the surface assembly.

SUMMARY

An example system includes: a wellhead having a wellhead load shoulder to support, within a wellbore, a tubular hanger connected to a tubular string, where the tubular hanger has a tubular hanger contact shoulder; and one or more sensors to generate one or more signals that are based on at least one of a proximity of the tubular hanger contact shoulder to the wellhead load shoulder or a contact between the tubular hanger contact shoulder and the wellhead load shoulder. The example system may include one or more of the following features, either alone or in combination.

The one or more sensors may include one or acoustic sensors to sense acoustic energy based on at least one of a proximity of the tubular hanger contact shoulder to the wellhead load shoulder or a contact between the tubular hanger contact shoulder and the wellhead load shoulder. The one or more sensors may include one or electromagnetic sensors to sense electromagnetic signals based on at least one of a proximity of the tubular hanger contact shoulder to the wellhead load shoulder or a contact between the tubular hanger contact shoulder and the wellhead load shoulder. The one or more sensors may include one or strain sensors to sense strain based on at least one of a proximity of the tubular hanger contact shoulder to the wellhead load shoulder or a contact between the tubular hanger contact shoulder and the wellhead load shoulder. The one or more sensors may include a combination of one or more of the following: acoustic sensors, electromagnetic sensors, or strain sensors.

The example system may include a device configured to generate an output that is based on the one or more signals. The device may include a meter having a display area to display the output. The device may be configured for wireless communication, for wired communication, or for both wireless communication and wired communication. The output may represent an extent to which the part of the tubular hanger contact shoulder is supported by the wellhead load shoulder.

The example system may include one or more processing devices to obtain first data based on the one or more signals, and to output second data for rendering on a display. The second data may be based on the first data and may represent an extent to which tubular hanger contact shoulder is supported by the wellhead load shoulder. The one or more sensors may include one or more acoustic sensors. The one or more acoustic sensors may generate, detect, or both generate and detect sound based on the contact, and may output the one or more signals that represent an acoustic signature response based on an extent to which the tubular hanger contact shoulder is supported by the wellhead load shoulder. The example system may include a coating at one or more locations relative to the wellhead load shoulder and the tubular hanger contact shoulder to amplify the sound.

The one or more electromagnetic sensors may be configured to create a magnetic field, to detect a magnetic field, or both to create and to detect a magnetic field. The magnetic field may be based on a contact or a proximity of the tubular hanger contact shoulder to the wellhead load shoulder. The one or more signals may correspond to an extent of the contact or the proximity of the tubular hanger contact shoulder to the wellhead load shoulder. The one or more electromagnetic sensors may include at least one magnet on the wellhead or the tubular hanger to create or to detect a change in the magnetic field resulting from the contact or the proximity between the tubular hanger contact shoulder and the wellhead load shoulder. The one or more electromagnetic sensors may be to detect a magnetic field based on a proximity of the tubular hanger contact shoulder to the wellhead load shoulder, and to output the one or more signals that represent an extent of the proximity of the tubular hanger contact shoulder to the wellhead load shoulder.

The one or more strain sensors may be configured to output the one or more signals based on a contact or a proximity of the tubular hanger contact shoulder to the wellhead load shoulder.

The one or more sensors may include a wireless sensor and the one or more signals may include wireless signals. The example system may include a wireless receiving device to generate a display based on the one or more wireless signals. The one or more sensors may include a wired sensor and the one or more signals may be transmitted over one or more wires. The example system may include a wired receiving device to generate a display based on the one or more signals.

The example system may include a mechanism for securing, at least temporarily, the one or more sensors to the wellhead or tubular hanger. The mechanism may include a belt that is secured around an outer diameter of the wellhead. The mechanism may include a magnet, a jig, or both a magnet and a jig. The one or more sensors may be for inducing, sensing, or inducing and sensing, at least two different physical phenomena. The one or more sensors may include one or more of the following: an electromagnetic sensor, an acoustic sensor, or a strain sensor. The mechanism may be configured for installation on a tubing or casing spool or wellhead housing. The mechanism may be configured for installation on a surface location. The mechanism may include one or more wired or wireless processing devices to generate data based on the one or more signals for transmission to a remote device that is wired or wireless.

The example system may include a mechanism for securing, permanently, the one or more sensors to the wellhead or tubular hanger. The mechanism may include a hole having a thread that is tapered. A sensor among the one or more sensors may be for mating to the thread. The mechanism may include a hole having a thread that is not tapered. A sensor among the one or more sensors may be for mating to the thread.

Any two or more of the features described in this specification, including in this summary section, may be combined to form implementations not specifically described in this specification.

At least part of the methods, systems, and techniques described in this specification may be controlled by executing, on one or more processing devices, instructions that are stored on one or more non-transitory machine-readable storage media. Examples of non-transitory machine-readable storage media include read-only memory, an optical disk drive, memory disk drive, random access memory, and the like. At least part of the methods, systems, and techniques described in this specification may be controlled using a computing system comprised of one or more processing devices and memory storing instructions that are executable by the one or more processing devices to perform various control operations.

The details of one or more implementations are set forth in the accompanying drawings and the following description. Other features and advantages will be apparent from the description and drawings, and from the claims.

DESCRIPTION OF THE DRAWINGS

Like reference numerals in different figures indicate like elements.

DETAILED DESCRIPTION

Described in this specification are example techniques for detecting landing of a tubular hanger in a wellhead. An example wellhead includes a load shoulder extending into a throughbore at an internal diameter of the wellhead. The load shoulder is configured to support a structure, known as a hanger, which suspends and supports tubulars extending downhole of the well. One or more sensors are configured to generate one or more signals based on an extent of contact between the structure and the load shoulder. A wired or wireless remote device, such as a meter or handheld unit, may be configured to output information based on these signals. The information may indicate, for example, whether the structure is properly supported by the load shoulder or whether the structure is not properly supported. The sensors may also generate signals during installation to track progress of the installation. Those signals may be used to identify problems during installation.

Figure 1:
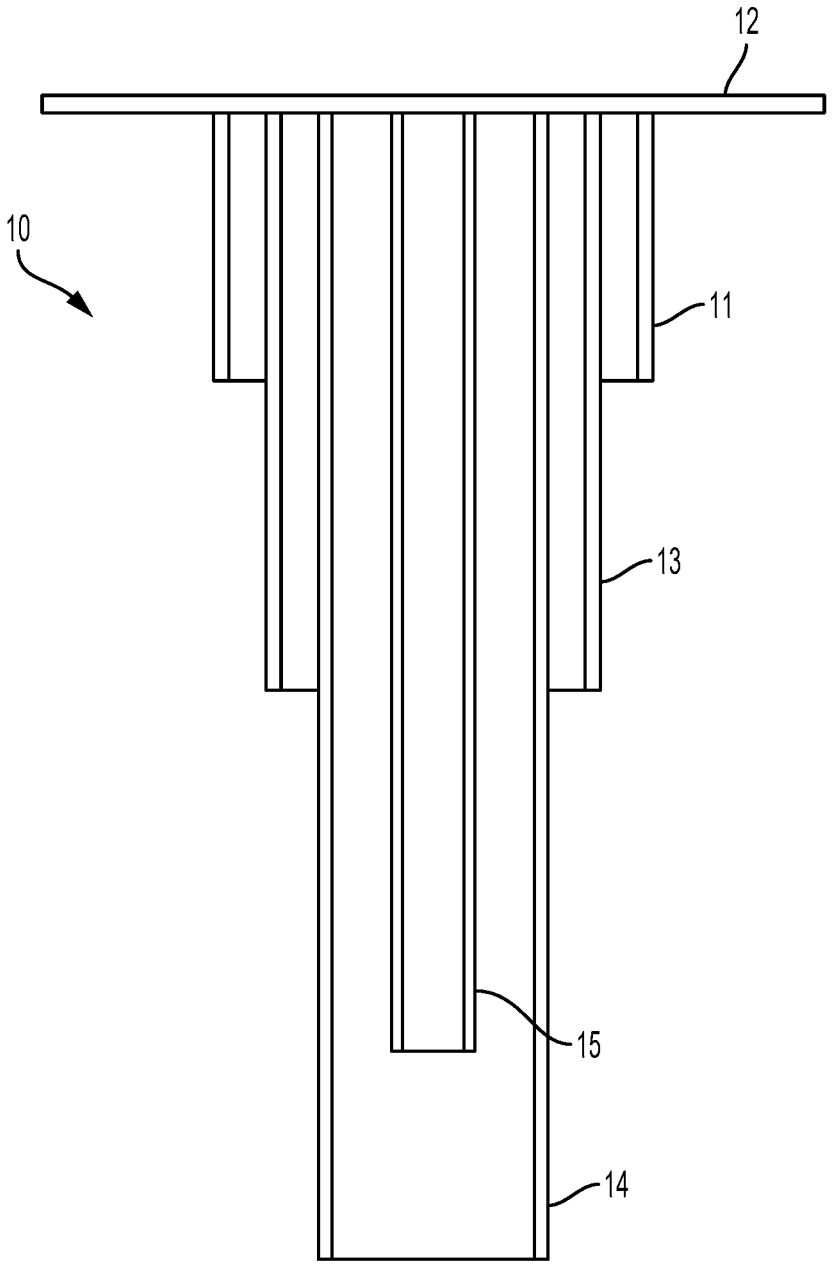
FIG. 1 is a cross-sectional block diagram of components of an example well construction tubular string configuration.

FIG. 1 shows an example implementation of a tubular configuration 10. The example of FIG. 1 includes surface casing 11 that reaches to surface 12; intermediate casing 13 that reaches to surface 12; production casing 14 that reaches to surface 12; and production tubing 15 that reaches to surface 12. Although only three casings or casing segments are included in the casing string of FIG. 1, a casing string may include any appropriate number of casings. In some implementations, tubular configuration 10 also includes structures (not labeled), such as wellheads, and tubular hangers or mandrel casing hangers that are configured to suspend, seal, and support downhole tubulars. In an example, a tubular hanger suspends downhole tubulars and includes a sealing system to ensure that the annular space between tubular strings hydraulically isolates tubular strings from one another. In an example, a tubular mandrel casing hanger enables downhole tubular strings to be reciprocated during installation and cementing operations.

The example system described in this specification may be configured to provide a positive indication that a tubular hanger landed on a load shoulder at an appropriate location. In some implementations, the system may reduce or eliminate the chances that the tubular hanger supporting downhole tubulars will be incorrectly installed, or will be set too high in the wellhead, thereby reducing the need for costly secondary operations to correct the installation. In some implementations, the system may be configured to detect errors during installation.

Figure 2:
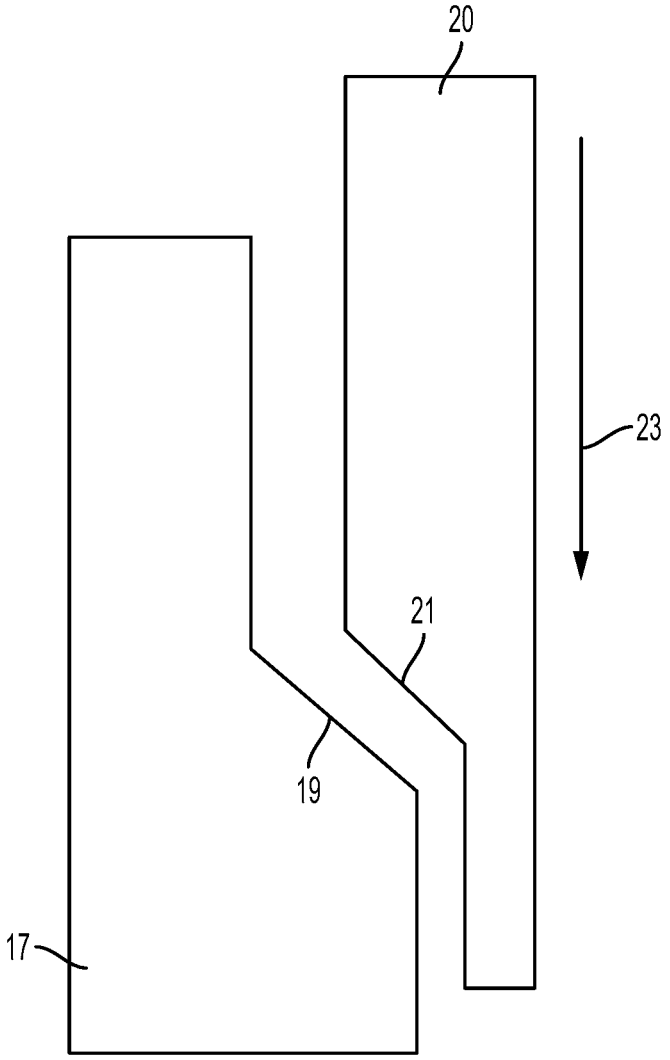
FIG. 2 is a cross-sectional block diagram of part of an example wellhead spool and corresponding tubular hanger.

FIG. 2 shows, conceptually, an example of a part of a wellhead 17 that supports a tubular hanger 20 threaded onto a downhole tubular string. A part of the tubular hanger 20 is shown in FIG. 2. In this regard, the downhole part of the tubular string supported by the wellhead and tubular hangers may include, for example, components such as packers, polished bore receptacles (PBR), and so forth. Generally, in this example, the downhole part of a tubular string may include any appropriate components that may be included downhole in a wellbore. Examples of downhole parts of a tubular string include casings 13, 14, and 15 of FIG. 1.

In the example of FIG. 2, wellhead 17 includes a ten centimeter (10 cm) to twenty-five centimeter (25 cm) thick irregularly-shaped cast steel housing. However, the system is not limited to a wellhead having these dimensions, to the shape shown in the figures, or to a forged or cast steel composition. Any appropriate wellhead or mandrel tubular hanger may be used. In this example, wellhead 17 includes a tapered or ninety-degree load shoulder 19 that extends into the internal diameter of wellhead 17, and is configured to support and to suspend tubular hanger 20. In this example, load shoulder 19 is at least five millimeters (5 mm) in length; however, the load shoulder may have any appropriate length, other dimensions, or shape.

The load shoulder 19 is configured to support, partly or fully, tubular hanger 20 and the tubular string that extends downhole of wellhead 17. Notably, the part of the tubular string that extends downhole of wellhead 17 may include components that are within or uphole of wellhead 17. The part of the tubular string that extends downhole of wellhead 17 may be supported, at least in part, by a structure, such as a tubular hanger or mandrel casing hanger 20 (referred to subsequently as "tubular hanger 20). The structure includes a tapered or ninety-degree downward-facing contact shoulder 21 that, in this example, has a shape that is compatible with, and uniform in relation to, the shape of load shoulder 19. For example, contact shoulder 21 is shaped so as to mate to, and be supported by, support shoulder 19 located on wellhead 17. Accordingly, as shown in FIG. 3, during construction of the well, tubular hanger contact shoulder 21 contacts wellhead load shoulder 19 and is supported by load shoulder 19.

Figure 3:
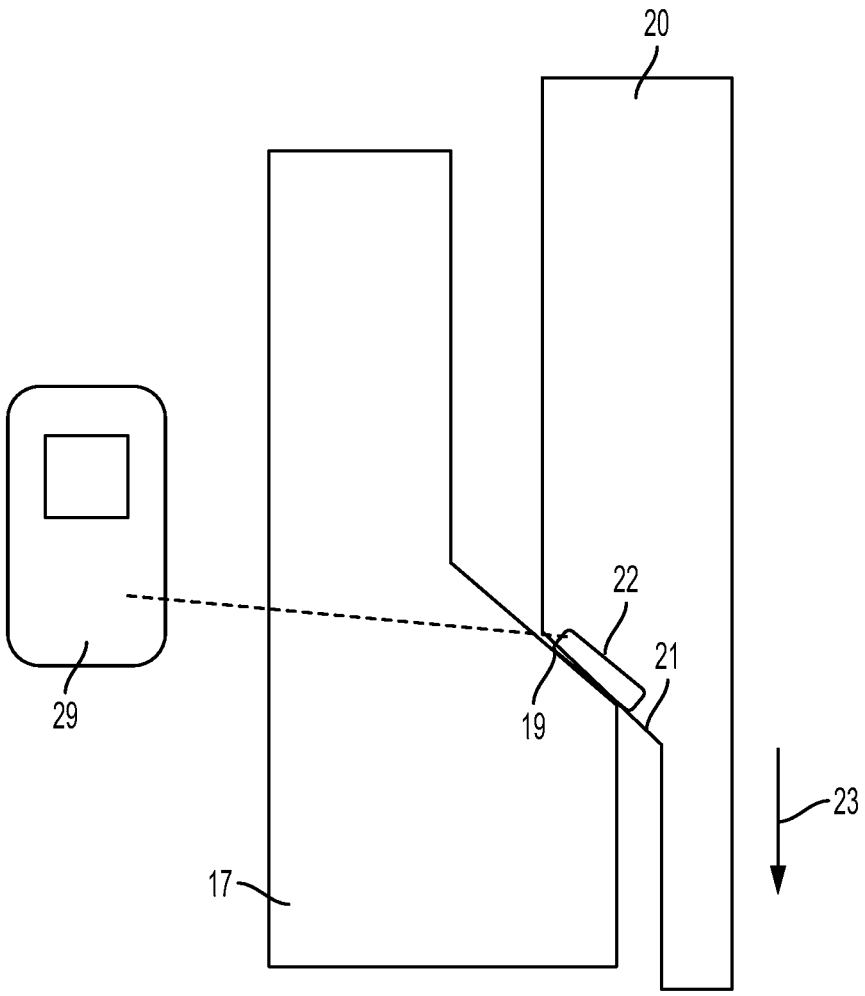
FIG. 3 is a cross-sectional block diagram of part of an example tubular hanger installed on tubular string landed on a load shoulder of an example wellhead.

Referring to both FIGS. 2 and 3, arrow 23 shows the direction that tubular hanger 20 moves during installation and eventual landing for support on wellhead load shoulder 19. If the contact shoulder lands on the load shoulder at a location that is improper or unintended, the part of the tubular string that is downhole may not be properly supported by the load shoulder, which can have adverse effects on the wellhead stack-up, tubular completion, or production of the well. In some wellhead and tubular hanger implementations, there is a predefined area of the load shoulder 19 on which the contact shoulder 21 should land in order to provide proper support for the downhole part of the tubular string. One or more combinations of sensors, coatings, or sensors and coatings 22 may be arranged at one or more appropriate locations in the wellhead or on the tubular hanger to generate, and to output, signals, data, or information that is indicative, or representative, of whether the tubular hanger contact shoulder 21 landed on the wellhead load shoulder 19, and is supported by the load shoulder 19, in the predefined area. In some implementations, the one or more sensors may be situated at one or more appropriate locations in the wellhead or on the tubular hanger to generate, and to output, signals, data, or information that is indicative, or representative, of whether tubular hanger 20 is being installed correctly, for example, prior to landing of the contact shoulder 21 on the load shoulder 19. In some implementations the sensors are configured for transmitting signals only, and in some implementations, the sensors are configured for both transmitting and receiving signals. In some implementations, the sensors may be programmed remotely through received signals, or may be queried for information through received signals.

In some implementations, the sensors include one or more electromagnetic sensors, one or more acoustic sensors, one or more strain sensors, or some combination of one or more electromagnetic sensors, one or more acoustic sensors, and one or more strain sensors. Other types of sensors may also be used alone or, as appropriate, in combination with one or more electromagnetic sensors, one or more acoustic sensors, or one or more strain sensors.

In an example, the one or more sensors may include one or more electromagnetic sensors. An example electromagnetic sensor may include one or more magnets, among other components. Each electromagnetic sensor may be configured to detect one or more magnetic fields based on a proximity of the tubular hanger contact shoulder 21 to the wellhead load shoulder 19, or based on contact between the contact shoulder 21 and the load shoulder 19, and to output one or more signals that represent the magnetic fields. For example, electromagnetic sensors may be incorporated at appropriate positions relative to wellhead load shoulder 19 and tubular hanger contact shoulder 21. In an example implementation, there may be a single electromagnetic sensor 22 on the tubular hanger contact shoulder 21 or on the wellhead load shoulder 19, four electromagnetic sensors equally-spaced or non-equally-spaced around the interior or exterior circumference of wellhead 17, or both an electromagnetic sensor on the load shoulder and four electromagnetic sensors equally-spaced or non-equally-spaced around the interior or exterior circumference of wellhead 17. In some implementations, there may be between one and six electromagnetic sensors. Any appropriate number of electromagnetic sensors may be used, and those electromagnetic sensors may be positioned at any appropriate locations.

Example electromagnetic sensors may detect changes in magnetic fields generated by the presence of tubular hanger contact shoulder 21 in the vicinity of the wellhead load shoulder 19—for example, in contact with or within a predefined distance of—wellhead load shoulder 19. For example, proper contact between the wellhead load shoulder 19 and tubular hanger contact shoulder 21 may produce a magnetic field having a predefined signature, such as flux, strength, or the like, with appropriate tolerances. For example, proper or expected movement of the contact shoulder 21 relative to the load shoulder 19 prior to actual contact between the contact shoulder 21 and the load shoulder 19 may produce a magnetic field having a predefined signature, such as flux, strength, or the like, with appropriate tolerances. The electromagnetic sensors may generate one or more signals based on the magnetic field produced when tubular hanger contact shoulder 21 moves into the vicinity of—for example, in contact with or within a predefined distance of—wellhead load shoulder 19. The generated signals may be processed to determine whether the detected magnetic field has the predefined signature, or is within an acceptable tolerance of the predefined signature.

In an example where the tubular hanger contact shoulder 21 has actually landed on the wellhead load shoulder 19, if the detected magnetic field has the predefined signature, or is within an acceptable tolerance of the predefined signature, it is determined that the contact shoulder 21 has landed properly on the load shoulder 19 and, therefore, that the load shoulder 19 is properly supporting the part of the tubular hanger 20 connected to the casing string that extends below the wellhead load shoulder 19. If the detected magnetic field does not have the predefined signature, or is not within an acceptable tolerance of the predefined signature, it is determined that the tubular hanger contact shoulder 21 has not landed properly on the wellhead load shoulder 19 and, therefore, that the load shoulder 19 is not properly supporting the part of the tubular hanger 20 connected to the casing string that extends below the load shoulder 19. In this latter case, the part of the tubular hanger 20 connected to the casing string that extends below the load shoulder 19, including any structure containing the tubular hanger 20, may be moved at least partly uphole, or removed from the wellbore entirely, and its installation may be attempted again.

In an example where the contact shoulder 21 has not yet landed on the load shoulder 19, if the detected magnetic field has an expected predefined signature, or is within an acceptable tolerance of the predefined signature, it is determined that the contact shoulder 21 is on the correct path to the load shoulder 19 and, therefore, that installation is proceeding as expected. If the detected magnetic field does not have the predefined signature, or is not within an acceptable tolerance of the predefined signature, it is determined that the contact shoulder 21 is not on the correct path to the load shoulder 19 and, therefore, that installation is not proceeding as expected. In this latter case, the part of the tubular hanger 20 that is being installed, including any structure containing the contact shoulder, may be moved at least partly uphole, or removed from the wellbore entirely, and its installation may be attempted again. In some implementations, the predefined signature of a magnetic field used to judge a proper landing is different than the predefined signature of the magnetic field used to judge a proper installation path.

Example acoustic sensors may be configured to detect one or more acoustic signatures based on contact, or impact, between the wellhead load shoulder 19 and the tubular hanger contact shoulder 21. For example, during installation, tubular hanger 20 moves downward inside of wellhead 17, resulting in tubular hanger contact shoulder 21 impacting wellhead load shoulder 19. As a result of this impact, a sound is produced. The sound has an acoustic signature that varies based on the extent of the impact. For example, the larger the area of contact is between the contact shoulder and the load shoulder, the greater the sound will be upon impact. For example, the smaller the area of contact is between the tubular hanger contact shoulder 21 and the wellhead load shoulder 19, the less the sound will be upon impact. In some examples, the frequency of the sound, or one or more other acoustic characteristics, may be different based on the extent of impact or proximity of the tubular hanger contact shoulder and the wellhead load shoulder. The acoustic sensors detect the sound resulting from impact or proximity, and output one or more signature signals based on that sound. For example, the acoustic sensors may detect the amplitude of the sound or the signature or the shape of the resulting sound waves. The acoustic sensors may be incorporated at appropriate positions relative to wellhead load shoulder 19 and tubular hanger contact shoulder 21. In some implementations, there may be between one and six acoustic sensors. Any appropriate number of acoustic sensors may be used, and those acoustic sensors may be positioned at any appropriate locations. In some implementations, one or more detectable coatings may be applied at appropriate locations relative to wellhead load shoulder 19 and tubular hanger contact shoulder 21 in order to amplify the sound received by the acoustic sensors. Thus, the acoustic sensors may be used in combination with detectable coatings.

Example acoustic sensors may be of the passive or listening type, the active, powered type, or a combination of the passive or listening type and the active, powered type. Active, powered-type devices are configured to add acoustic energy to the environment in which they are located, which may make it easier to identify a characteristic response using other active devices or passive devices. For example, an active acoustic sensor may "ping" an area in order to monitor and to detect relative positions of the wellhead load shoulder and tubular hanger contact shoulder. Acoustic reflections off of these structures may be used to identify their locations.

As noted, example acoustic sensors may detect acoustic signatures resulting from the contact or proximity of wellhead load shoulder 19 and tubular hanger contact shoulder 21. For example, proper contact between the wellhead load shoulder 19 and tubular hanger contact shoulder 21 may produce an acoustic signature having a predefined characteristic, which may be defined, at least in part, by the sound's amplitude. The acoustic sensors may generate one or more signals based on the acoustic signature produced when tubular hanger contact shoulder 21 impacts wellhead load shoulder 19. These signals may be processed to determine whether a detected acoustic signature has the predefined characteristic, or is within an acceptable tolerance of the predefined characteristic. If the detected acoustic signature has the predefined characteristic, or is within an acceptable tolerance of the predefined characteristic, it is determined that the tubular hanger contact shoulder 21 has landed properly on the wellhead load shoulder 19 and, therefore, that the wellhead load shoulder 19 is properly supporting the part of the tubular hanger 20 connected to the casing string that extends below the wellhead load shoulder 19. If the detected acoustic signature does not have the predefined characteristic, or is not within an acceptable tolerance of the predefined characteristic, it is determined that the tubular hanger contact shoulder 21 has not landed properly on the wellhead load shoulder 19 and, therefore, that the wellhead load shoulder 19 is not properly supporting the part of the tubular hanger 20 connected to the casing string that extends below the wellhead load shoulder 19. In this latter case, the part of the tubular hanger 20 connected to the casing string that extends below the wellhead load shoulder 19, including any structure containing or supporting the tubular hanger 20 may be moved at least partly uphole, or removed from the wellbore entirely, and its installation may be attempted again.

In some implementations, the acoustic sensors may be configured to detect acoustic energy during installation of part of the tubular hanger 20 attached to the casing string, for example, in cases where the tubular hanger contact shoulder 21 has not yet landed on the wellhead load shoulder 19. In examples like this, if unexpected sounds are detected prior to contact between the tubular hanger contact shoulder 21 and the wellhead load shoulder 19, the part of the tubular hanger 20 that is being installed, including any structure containing the tubular hanger contact shoulder 21, may be moved at least partly uphole, or removed from the wellbore entirely, and its installation may be attempted again.

Example strain sensors, such as strain gauges, may be configured to detect strain in the wellhead 17 based on contact, or impact, between the wellhead load shoulder 19 and the tubular hanger contact shoulder 21. For example, during installation, tubular hanger 20 moves downward inside of wellhead 17, resulting in the tubular hanger contact shoulder 21 impacting wellhead load shoulder 19. As a result of this impact and subsequent contact, strain registers between the wellhead load shoulder 19 and the tubular hanger contact shoulder 21. The magnitude and location of the strain has a signature that varies based on the location of the contact. For example, the larger the area of contact is between the tubular hanger contact shoulder 21 and the wellhead load shoulder 19, the less strain there may be on areas around the point of contact. For example, the smaller the area of contact is between the tubular hanger contact shoulder 21 and the wellhead load shoulder 19, the more strain there may be on areas around the point of contact. The strain sensors may be configured to detect this strain. In some implementations, there may be between one and six strain sensors. Any appropriate number of strain sensors may be used, and those strain sensors may be positioned at any appropriate locations relative to the tubular hanger contact shoulder 21 or wellhead load shoulder 19.

As noted, example strain sensors may detect strain resulting from the contact of wellhead load shoulder 19 and tubular hanger contact shoulder 21. For example, proper contact between the wellhead load shoulder 19 and tubular hanger contact shoulder 21 may produce an expected strain, such as an expected strain magnitude, distribution, or both in wellhead 17 or tubular hanger 20 components. The strain sensors may generate one or more signals based on measurements of the strain produced when tubular hanger contact shoulder 21 is supported by wellhead load shoulder 19. These signals may be processed to determine whether a detected magnitude, distribution, or both of strain matches the expected strain, or is within an acceptable tolerance of the expected strain. If the detected strain matches the expected strain, or is within an acceptable tolerance of the expected strain, it is determined that the tubular hanger contact shoulder 21 has landed properly on the wellhead load shoulder 19 and, therefore, that the wellhead load shoulder 19 is properly supporting the part of the tubular hanger 20 attached to the casing string that extends below the wellhead load shoulder 19. If the detected strain does not match the expected strain, or is not within an acceptable tolerance of the expected strain, it is determined that the tubular hanger contact shoulder 21 has not landed properly on the wellhead load shoulder 19 and, therefore, that the wellhead load shoulder 19 is not properly supporting the part of the tubular hanger 20 attached to the casing string that extends below the wellhead load shoulder 19. In this latter case, the part of the tubular hanger 20 that extends below the wellhead load shoulder 19, including any structure containing the tubular hanger contact shoulder 21, may be moved at least partly uphole, or removed from the wellbore entirely, and its installation may be attempted again.

In some implementations, the strain sensors may be configured to detect strain in the tubular hanger 20, in the wellhead 17, or in both in cases where the tubular hanger contact shoulder 21 has not yet landed on the wellhead load shoulder 19. In examples like this, if unexpected strain is detected prior to contact between the tubular hanger contact shoulder 21 and the wellhead load shoulder 19, the part of the tubular hanger 20 that is being installed, including any structure containing the tubular hanger contact shoulder 21, may be moved at least partly uphole, or removed from the wellbore entirely, and its installation may be attempted again.

In some implementations, the sensors may include a combination of one or more electromagnetic sensors, one or more acoustic sensors, or one or more strain sensors. In some implementations, the sensors may include a combination of one or more electromagnetic sensors, one or more acoustic sensors, and one or more strain sensors. For example, the sensors may include an electromagnetic sensor, a strain sensor, and an acoustic sensor, or any appropriate combination of one or more electromagnetic sensors, strain sensors, or acoustic sensors. Different sensors may be configured for detection at the same time—for example the entire time—during installation or at different times during installation.

Figure 4:
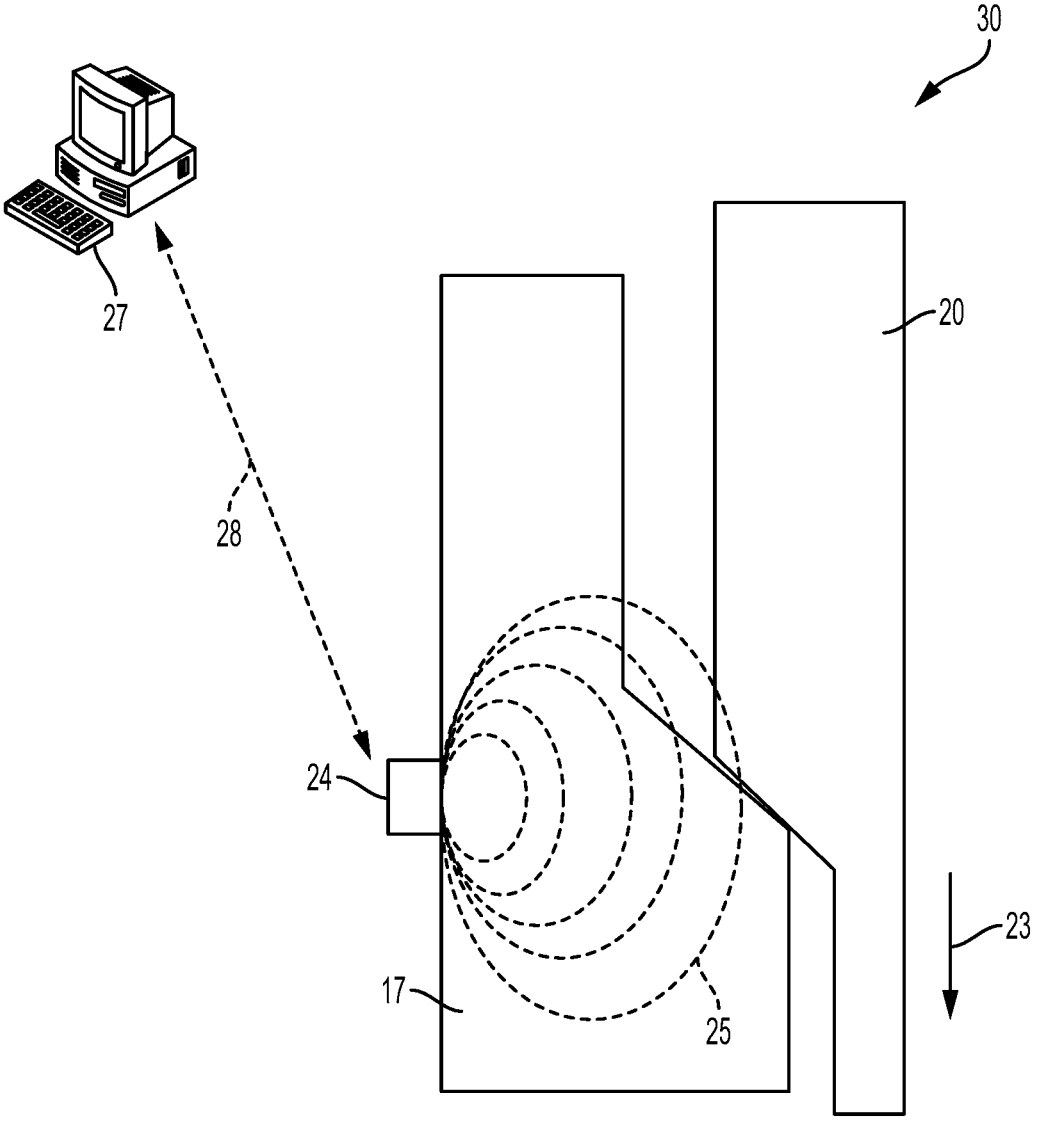
FIG. 4 is a cross-sectional block diagram of a sensor on part of an example wellhead spool having a load shoulder that supports an example tubular hanger.

In some implementations, the sensors may be arranged on, or fixed to, the wellheads or tubular hangers, or any other appropriate structure in the wellbore. For example, the sensors may be mounted in holes, or using appropriate mounting mechanisms, to the exterior, to the interior, or to both the exterior and the interior of the wellhead 17, the tubular hanger 20, or both the wellhead 17 and the tubular hanger 20. The holes may have tapered or untapered screw threads that penetrate the wellhead 17, the tubular hanger 20, or both the wellhead 17 and the tubular hanger 20. The sensors may be arranged on, or held on, a temporary device, such as a belt that attaches to the wellhead. For example, the sensors may be attached to a temporarily-affixed sensor belt or jig that is configured for installation on a wellhead, or that is configured for installation on a prepared surface location of the wellhead. The sensor belt may fit around an exterior circumference of the wellhead 17 containing, and proximate to, the load shoulder 19, or at any other appropriate location on the wellhead. FIG. 4 shows part of an example sensor or sensor belt 24 secured around an exterior circumference of wellhead 17. FIG. 4 also shows, conceptually, signals 25 that are detectable by the sensors. In the example of FIG. 4, a wired or wireless portable unit, handheld device, or computing system 27 communicates 28 with the sensor or sensor belt 24.

Figure 8:
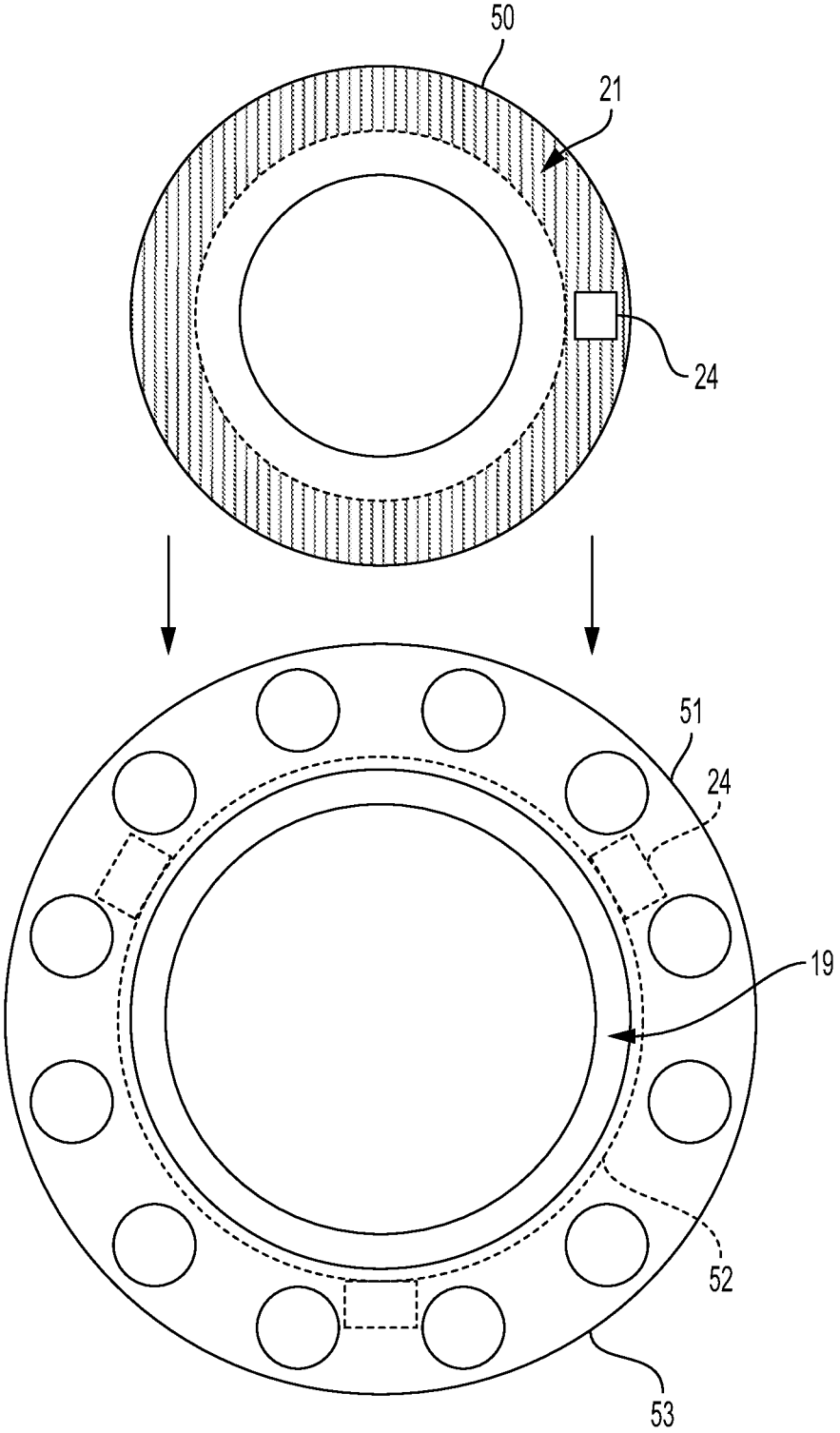
FIG. 8 is a plan view of example wellhead and hanger sections showing example sensor positions.
Figure 9:
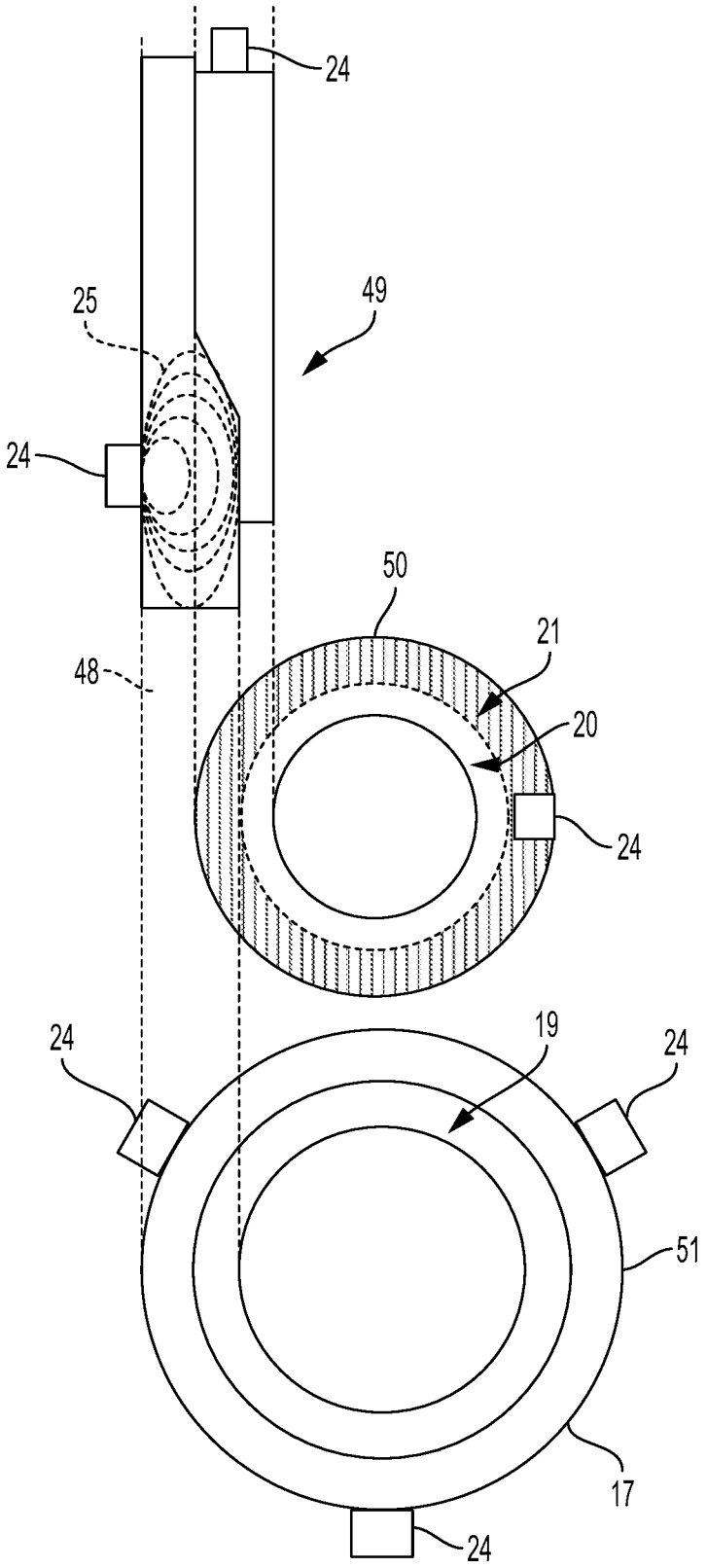
FIG. 9 is an elevation view showing example sensor positions.

FIG. 8 is a top or plan view of an example wellhead section 51 and tubular hanger 52 section obtained by looking downhole at the wellhead and hangar sections. Wellhead section 51 also shows the exterior 52 of the wellhead below its top flange, and the wellhead top flange 53. FIG. 9 is a top view of the example wellhead and tubular hanger sections above the top view of FIG. 8. Referring also to FIG. 4, using dashed lines 48, FIG. 9 shows examples of where the components of diagram 49 may be located in wellhead section 51 and hanger 52 section.

In some implementations, as described, a sensor package, which may include a holding mechanism such as a sensor belt, may be installed onto a wellhead in order to monitor changing conditions as the tubular hanger moves through the wellhead and eventually contacts and lands on the wellhead load shoulder. The sensor belt may be powered by battery or by an external source. As explained previously, multiple sensors of a same type or of different types may be used either individually or as an array to enable circumferential identification of the landing. The sensor or sensor belt may be configured for installation onto either prepared surface locations—for example, both in vertical and horizontal axes—on a wellhead or onto a rough forged or cast and painted surface.

Sensors on or off the sensor belt may be wired or wireless. In some implementations, wires may run between the sensors and a remote device, such as a meter, a portable unit, a handheld device, or a computing system. The wires may transmit signals between the sensors and the remote device. In some implementations, signals may be transmitted wirelessly between the sensors and the remote device. For example, the signals may be radio frequency (RF) signals or other appropriate wireless signals. In some implementations, the signals transmitted may be a combination of wired and wireless signals. In some implementations, the signals are based on a contact of the wellhead load shoulder 19 and the tubular hanger contact shoulder 21, which is attached to the casing string supported by the wellhead load shoulder 19 that extends downhole below the load shoulder 19. In some implementations, the signals represent an extent to which the part of the tubular hanger 20 attached to the casing string that extends downhole below the load shoulder 19 is supported by the load shoulder 19. In some implementations, the signals are based on a proximity of the wellhead load shoulder 19 to the tubular hanger contact shoulder 21. As explained previously, values representing sound changes detected by acoustic sensors, magnetic field changes detected by electromagnetic sensors, or strain changes detected by strain sensors may be transmitted by the sensors to a remote device as one or more signals. The remote device or reader 29 may then interpret, or process, those signals in order to determine the extent to which the wellhead load shoulder 19 supports the part of the tubular hanger 20 that extends downhole below the load shoulder 19, or the extent to which the tubular hanger 20 installation is proceeding as expected.

In some implementations, therefore, the signals transmitted from the sensors to the remote device are signals that represent the actual physical phenomena measured by the sensors. For example, signals may represent the amount of strain measured, the change of a magnetic field, or the acoustic changes identified upon contact of the tubular hanger contact shoulder 21 and wellhead load shoulder 19. In examples where the signals represent the actual physical phenomena measured by the sensors, the remote device may include intelligence to process, and to interpret, the signals. For example, the remote device may be, or include, a wired or wireless portable unit, a handheld device, or a computing system comprised of one or more processing devices. The computing system may receive the signals, convert the signals into digital data that represents the signals, and process the digital data to make a determination about the extent to which the wellhead load shoulder 19 supports the part of the tubular hanger 20 attached to the casing string that extends downhole below the load shoulder 19 or the extent to which the installation is proceeding as expected.

The computing system may generate data to render graphics showing, in numbers, words, images, or a combination of numbers, words, and images, the extent to which the wellhead load shoulder 19 supports the part of the tubular hanger 20 attached to the casing string that extends downhole below the load shoulder 19. The computing system may generate data to render graphics showing, in in numbers, words, images, or a combination of numbers, words, and images, installation progress of the tubular hanger 20 attached to the casing string intended to extend downhole below the load shoulder 19. In some implementations, the computing system may generate data to output verbal notifications that are indicative of the extent to which the wellhead load shoulder 19 supports the part of the tubular hanger 20 attached to the casing string that extends downhole below the load shoulder 19, or the installation progress of the tubular hanger 20 attached to the casing string intended to extend downhole below the load shoulder 19.

In some implementations, the computing system may control a portable unit, a handheld device, or a meter, which itself may include no onboard intelligence or limited onboard intelligence. The portable unit, handheld device or meter may provide an indication, based on controls provided by the computing system, about the extent to which the wellhead load shoulder 19 supports the part of the tubular hanger 20 attached to the casing string that extends downhole below the load shoulder 19. For example, the portable unit, handheld device, or meter may be, or may include, a simple identification or status device that displays (for example) a traffic light-type confirmation of acceptable landing across all or some of the sensors described previously. In some implementations, the portable unit, handheld device or meter may provide an indication of an error or other problem associated with installation of the tubular hanger 20 attached to the casing intended to extend below the load shoulder. In some implementations, the portable unit, handheld device or meter may include one or more processing devices to receive signals directly from the sensor or digital data from elsewhere, and to process the signals or data to generate appropriate indications, such as those described in this specification.

In some implementations, the mechanism for securing a sensor, such as a sensor belt, may include an onboard computing system (not shown), which may include one or more processing devices. The onboard computing system may be configured, or programmed, to receive signals from the sensors, to process the signals, and to interpret the signals. For example, the onboard computing system may receive the signals, convert the signals into digital data that represents the signals, and process the digital data to make a determination about the extent to which the wellhead load shoulder 19 supports the part of the tubular hanger 20 attached to the casing string that extends downhole below the load shoulder 19.

The onboard computing system may generate data to render graphics showing, in numbers, words, images, or a combination of numbers, words, or images, the extent to which the wellhead load shoulder 19 supports the part of the tubular hanger 20 attached to the casing string that extends downhole below the load shoulder 19. The onboard computing system may generate data to render graphics showing, in numbers, words, images, or a combination of numbers, words, or images, installation progress for the part of the tubular hanger 20 attached to the casing string that is intended to extend downhole below the load shoulder 19. In some implementations, the computing system may generate data to output verbal notifications that are indicative of the extent to which the load shoulder 19 supports the part of the tubular hanger 20 attached to the casing string that extends downhole below the load shoulder, or the installation progress of that tubular hanger 20. The data generated may be output via a wired connection, a wireless connection, or both, to one or more devices for output. In some implementations, the onboard computing system may control a meter, such as the meter described previously, to produce an indication based on the data generated. In some implementations, the data may be output from the onboard computing system to a remote handheld unit or computing system for further processing, to generate a display, or to both.

Figure 5:
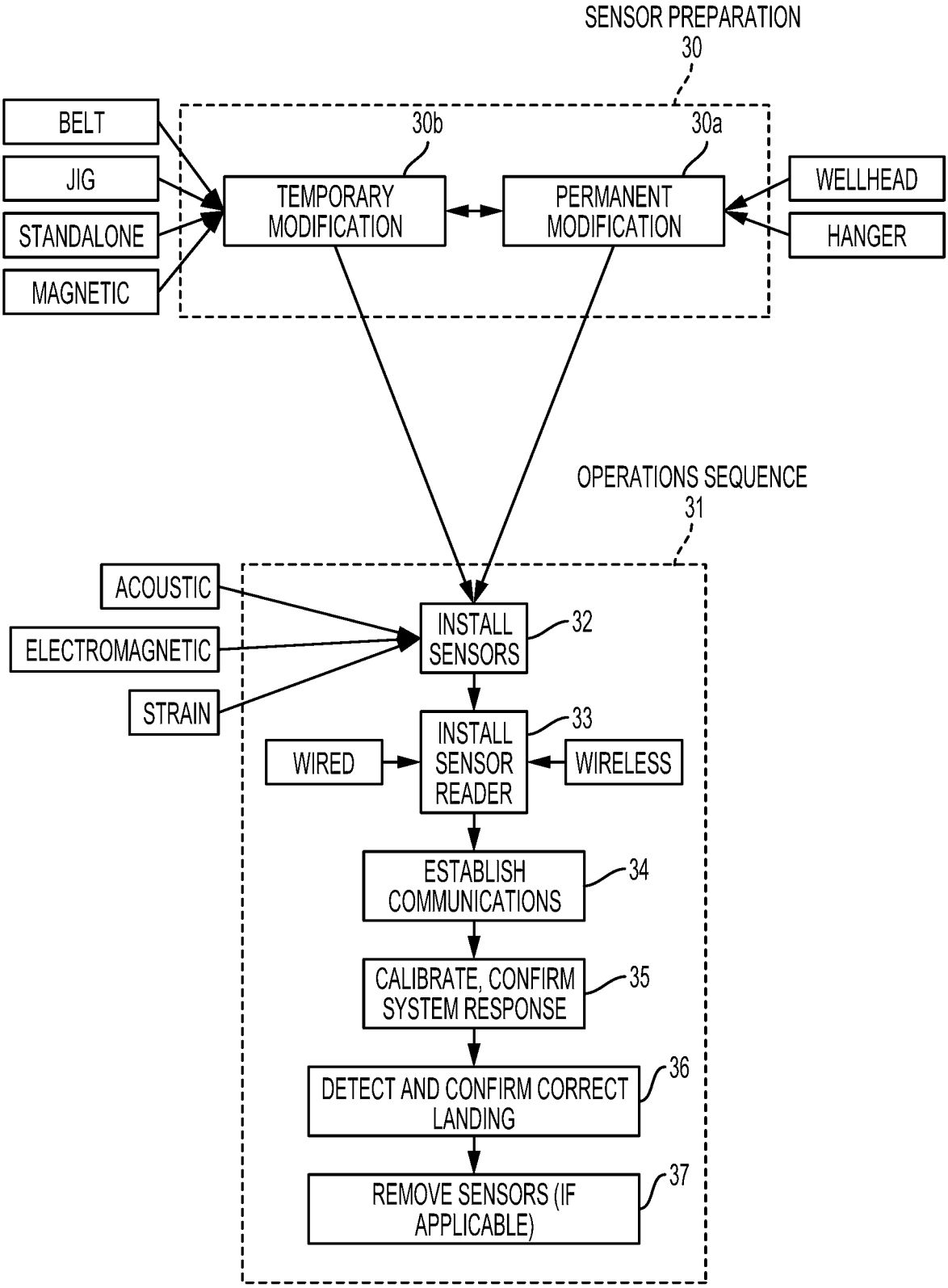
FIG. 5 is a flowchart showing an example process for installing a sensor or sensors on an example wellhead or tubular hanger and for performing a landing operation.

An example installation process may include the operations shown in FIG. 5. Referring to FIG. 5, sensors are prepared (30). This may include making the sensors a permanent modification (30*a*) to the wellhead or hanger, or making the sensors a temporary modification (30*b*). For example, temporary sensors may be stand-alone, magnetic, or be part of belt or a jig. Following preparation (30), example operations sequence 31 may be performed. The sensors may be installed (32). As noted, and as shown in FIG. 5, the sensors may be one or more of, acoustic sensors, electromagnetic sensors, or strain sensors. In an example, the sensors may be installed temporarily or permanently on a wellhead using a mechanical mechanism. The mechanical mechanism may be configured to provide a correct location of individual sensors, and position, contact, and coupling to an external surface of the spool body.

Figure 6:
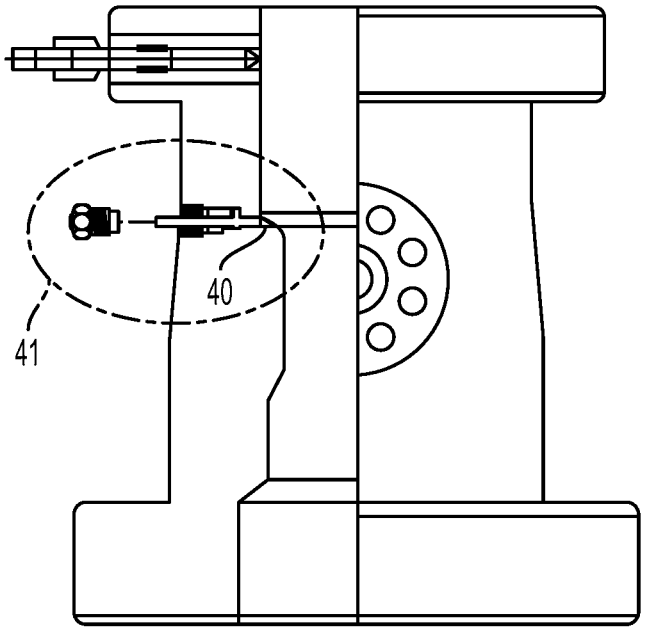
FIG. 6 is a cross-sectional diagram of a part of an example wellhead containing an electromagnetic sensor in a sealed port penetrating the wellhead to the load shoulder.
Figure 7:
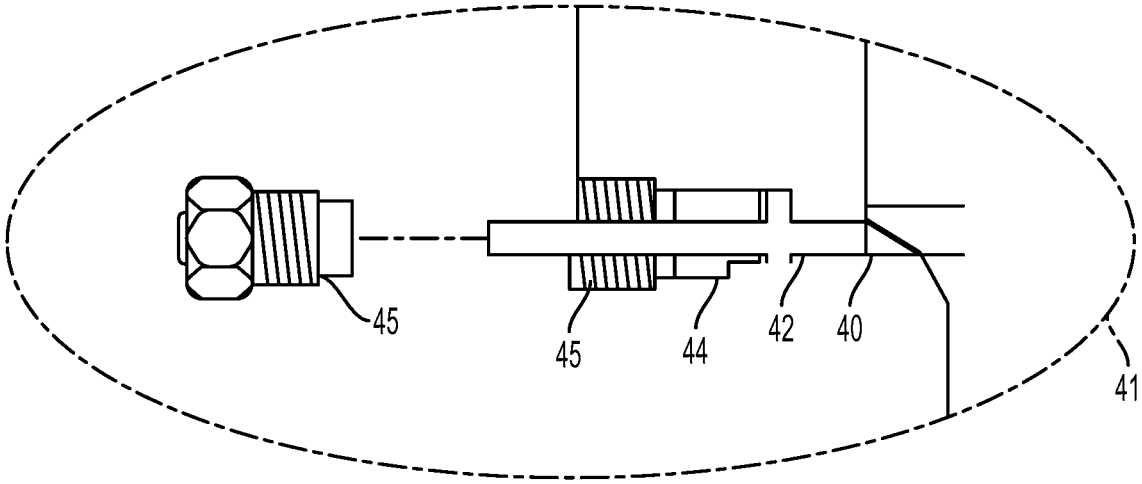
FIG. 7 is a portion of the image of FIG. 6 enlarged.

In some implementations, port locations penetrating the wellhead body may be pre-drilled or tapped to allow a screw-in connection or connections of one or more of the sensors. In some implementations, the port may incorporate high pressure seal 44 (see FIG. 7) capability to prevent wellbore hydrocarbon communication to the atmosphere. For example, FIGS. 6 and 7 show an implementation that includes a magnetic sensor 40 installed in a hole formed in the wellhead. Area 41 is shown enlarged in FIG. 7. In this example, the hole 42 is formed, then sensor stem 40 is installed and, in this example, packing 44 and a high-pressure packing gland 45 are installed to close and seal the outer diameter of the sensor stem and port. The hole is not shown closed in FIG. 7. Other configurations may use different components than those shown in FIGS. 6 and 7.

In some implementations, sensors may be installed following installation of a sensor belt or other securing mechanism. In implementations such as this, further sensor installation is performed after installation. In some implementations, the sensors are installed prior to installation of a sensor belt or other securing mechanism. In implementations such as this, further sensor installation is not required. In some implementations, a remote device or sensor reader is installed (33) for communication to the sensors. As noted, and as shown in FIG. 5, this device or reader may be wired or wireless. In some implementations, the remote device or sensor reader may be pre-installed and no further installation may be needed.

As part of the operations sequence, communications may established (34) with the remote device or sensor reader. As noted, the remote device or sensor reader may be a wired or wireless meter, handheld unit, a computer, or a combination of these, for example. The communications may be established using a verification routine that confirms (35) an acceptable response from the sensors when installed. In an example, an acceptable response may include receipt of an expected response following transmission of a predefined signal. In some implementations, calibration (35) may be performed to determine ensure proper response detection.

As a tubular hanger, such as tubular hanger 20 of FIGS. 2 to 4, is lowered into the wellhead, in some implementations, the system responds using a traffic light identification system, first noting that the tubular hanger has entered the proximity of its final resting position, then confirming that the tubular hanger is in the correct position. For example, a yellow light displayed may indicate that that the tubular hanger has entered the proximity of its final landing position in wellhead 17 on the contact shoulder 19, and a green light displayed may indicate that the hanger is in the correct landing and suspension position in wellhead 17 on the contact shoulder 19. If the tubular hanger is not in the correct position, an indication to that effect is output, as appropriate. For example, a red light may be displayed to indicate that the tubular hanger is not in the correct landing and suspension position in wellhead 17 on the contact shoulder 19 or is not on track to reach the correct position, as determined by analysis of one or more of the sensor signals. As described previously, sensors, such as the electromagnetic sensors, may be configured to detect changes in physical phenomena, such as magnetic fields, before contact between the tubular hanger 20 and the contact shoulder 19. Accordingly, information based on sensor readings or signals may be processed or otherwise used to determine that the tubular hanger has entered the proximity of its final resting landing and suspension position in wellhead 17 on the contact shoulder 19 or is on track to reach that final resting landing and suspension position.

In some implementations, following detection and confirmation (36) of a successful tubular hanger landing, the mechanism for securing the sensors, such as the sensor belt, may be removed (37) from the wellhead exterior if necessary or applicable. Surfaces where the sensor belt was in contact with the casing or spool may be inspected and treated with preservatives, as appropriate, for long term service and environmental exposure. In some implementations, the mechanism for securing the sensors may be permanent, and may remain in the well and be used for monitoring during operation of the well or for other appropriate purposes.

Although vertical wellbores are shown and described in the examples presented in this specification, the example systems and methods described in this specification may be implemented in wellbores that are, in whole or part, non-vertical. For example, the systems and methods may be performed in deviated wellbores, horizontal wellbores, or partially horizontal wellbores. In some implementations, horizontal and vertical are defined relative to the Earth's surface.

All or part of the systems and methods described in this specification and their various modifications (subsequently referred to as "the systems") may be controlled at least in part by, or employing, one or more computers using one or more computer programs tangibly embodied in one or more information carriers, such as in one or more non-transitory machine-readable storage media. A computer program can be written in any form of programming language, including compiled or interpreted languages, and it can be deployed in any form, including as a stand-alone program or as a module, part, subroutine, or other unit suitable for use in a computing environment. A computer program can be deployed to be executed on one computer or on multiple computers at one site or distributed across multiple sites and interconnected by a network.

Actions associated with controlling the systems can be performed by one or more programmable processors executing one or more computer programs to control all or some of the well formation operations described previously. All or part of the systems can be controlled by special purpose logic circuitry, such as, an FPGA (field programmable gate array) and/or an ASIC (application-specific integrated circuit).

Processors suitable for the execution of a computer program include, by way of example, both general and special purpose microprocessors, and any one or more processors of any kind of digital computer. Generally, a processor will receive instructions and data from a read-only storage area or a random access storage area or both. Elements of a computer include one or more processors for executing instructions and one or more storage area devices for storing instructions and data. Generally, a computer will also include, or be operatively coupled to receive data from, or transfer data to, or both, one or more machine-readable storage media, such as mass storage devices for storing data, such as magnetic, magneto-optical disks, or optical disks. Non-transitory machine-readable storage media suitable for embodying computer program instructions and data include all forms of non-volatile storage area, including by way of example, semiconductor storage area devices, such as EPROM (erasable programmable read-only memory), EEPROM (electrically erasable programmable read-only memory), and flash storage area devices; magnetic disks, such as internal hard disks or removable disks; magneto-optical disks; and CD-ROM (compact disc read-only memory) and DVD-ROM (digital versatile disc read-only memory).

Elements of different implementations described may be combined to form other implementations not specifically set forth previously. Elements may be left out of the systems described previously without adversely affecting their operation or the operation of the system in general. Furthermore, various separate elements may be combined into one or more individual elements to perform the functions described in this specification.

Other implementations not specifically described in this specification are also within the scope of the following claims.

What is claimed is:

1. A system comprising:

a wellhead comprising a wellhead load shoulder supporting, within a wellbore, a tubular hanger connected to a tubular string, the tubular hanger having a tubular hanger contact shoulder;

at least one port disposed within the wellhead, the at least one port comprising:

a high-pressure seal; and a high-pressure packing gland, and sensors detecting one or more physical phenomena as the tubular hanger contact shoulder approaches the wellhead load shoulder and generating signals based on at least one of a proximity of the tubular hanger contact shoulder to the wellhead load shoulder or a contact between the tubular hanger contact shoulder and the wellhead load shoulder, the sensors being arranged around a circumference of the wellhead load shoulder at a location proximate to the wellhead load shoulder, the one or more physical phenomena changing as the tubular hanger contact shoulder approaches the wellhead load shoulder, the sensors comprising at least one sensor stem, where the at least one sensor stem is installed in the at least one port, and where both the high-pressure seal and the high-pressure packing gland seal an outer diameter of the at least one sensor stem and the at least one port.

2. The system of claim 1, where the sensors comprise one or more acoustic sensors sensing acoustic energy based on at least one of a proximity of the tubular hanger contact shoulder to the wellhead load shoulder and a contact between the tubular hanger contact shoulder and the wellhead load shoulder, the one or more physical phenomena comprising the acoustic energy.

3. The system of claim 1, where the sensors comprise one or more electromagnetic sensors sensing electromagnetic signals based on at least one of a proximity of the tubular hanger contact shoulder to the wellhead load shoulder and a contact between the tubular hanger contact shoulder and the wellhead load shoulder, the one or more physical phenomena comprising the electromagnetic signals.

4. The system of claim 1, where the sensors comprise one or more strain sensors sensing strain based on at least one of a proximity of the tubular hanger contact shoulder to the wellhead load shoulder and a contact between the tubular hanger contact shoulder and the wellhead load shoulder, the one or more physical phenomena comprising the strain.

5. The system of claim 1, where the sensors comprise a combination of one or more of the following: acoustic sensors, electromagnetic sensors, or strain sensors.

6. The system of claim 1, further comprising:

a device configured generating an output that is based on the signals.

7. The system of claim 6, where the device comprises a meter having a display area displaying the output.

8. The system of claim 6, where the device is configured for wireless communication, for wired communication, or for both wireless communication and wired communication.

9. The system of claim 6, where the output represents an extent to which the part of the tubular hanger contact shoulder is supported by the wellhead load shoulder.

10. The system of claim 1, further comprising:

one or more processing devices obtaining first data based on the signals, and outputting second data for rendering on a display, the second data being based on the first data and representing an extent to which tubular hanger contact shoulder is supported by the wellhead load shoulder.

11. The system of claim 1, where the sensors comprise one or more acoustic sensors, the one or more acoustic sensors generating, detecting, or both generating and detecting sound based on the contact and outputting the signals that represent an acoustic signature response based on an extent to which the tubular hanger contact shoulder is supported by the wellhead load shoulder.

12. The system of claim 11, further comprising:

a coating at one or more locations relative to the wellhead load shoulder and the tubular hanger contact shoulder amplifying the sound.

13. The system of claim 1, where the sensors comprise one or more electromagnetic sensors, the one or more electromagnetic sensors detecting a magnetic field, the magnetic field being based on a contact or a proximity of the tubular hanger contact shoulder to the wellhead load shoulder, and the signals corresponding to an extent of the contact or the proximity of the tubular hanger contact shoulder to the wellhead load shoulder.

14. The system of claim 13, where the one or more electromagnetic sensors detect a change in the magnetic field resulting from the contact or the proximity between the tubular hanger contact shoulder and the wellhead load shoulder.

15. The system of claim 1, where the sensors comprise one or more electromagnetic sensors, the one or more electromagnetic sensors detecting a magnetic field based on a proximity of the tubular hanger contact shoulder to the wellhead load shoulder, and outputting the signals that represent an extent of the proximity of the tubular hanger contact shoulder to the wellhead load shoulder.

16. The system of claim 1, where the sensors comprise one or more strain sensors outputting the signals based on a contact or a proximity of the tubular hanger contact shoulder to the wellhead load shoulder.

17. The system of claim 1, where the sensors comprise a wireless sensor and the signals comprise wireless signals; and where the system comprises a wireless receiving device generating a display based on the wireless signals.

18. The system of claim 1, where the sensors comprise a wired sensor and the signals are transmitted over one or more wires; and where the system comprises a wired receiving device generating a display based on the signals.

19. The system of claim 1, where the system further comprises a mechanism for securing, at least temporarily, the sensors to the wellhead or tubular hanger.

20. The system of claim 19, where the mechanism comprises a belt that is secured around an outer diameter of the wellhead.

21. The system of claim 19, where the mechanism comprises a magnet.

22. The system of claim 19, where the mechanism is configured for installation on a surface location.

23. The system of claim 19, where the sensors are for sensing at least two different physical phenomena.

24. The system of claim 19, where the sensors comprise one or more of the following: an electromagnetic sensor, an acoustic sensor, or a strain sensor.

25. The system of claim 19, where the mechanism is configured for installation on a tubing or casing spool, or on a wellhead housing.

26. The system of claim 19, where the mechanism comprises one or more wired or wireless processing devices generating data based on the signals for transmission to a remote device that is wired or wireless.

27. The system of claim 1, where the system further comprises a mechanism for securing, permanently, the sensors to the wellhead or tubular hanger.

28. The system of claim 27, where the mechanism comprises one or more threads disposed within the at least one port for securing at least one sensor of the sensors within the at least one port.

29. The system of claim 28, where the one or more threads is tapered.

* * * * *